US007543418B2

(12) United States Patent
Weitzer

(10) Patent No.: US 7,543,418 B2
(45) Date of Patent: Jun. 9, 2009

(54) PANEL ELEMENT AND CONNECTING SYSTEM FOR PANEL ELEMENTS

(75) Inventor: Wilfried Weitzer, Weiz (AT)

(73) Assignee: Weitzer Parkett GmbH & Co. K.G. (AT)

( * ) Notice: Subject to any disclaimer, the term of this patent is extended or adjusted under 35 U.S.C. 154(b) by 599 days.

(21) Appl. No.: 10/520,038

(22) PCT Filed: Jun. 18, 2003

(86) PCT No.: PCT/EP03/06474

§ 371 (c)(1),
(2), (4) Date: Apr. 8, 2005

(87) PCT Pub. No.: WO2004/005648

PCT Pub. Date: Jan. 15, 2004

(65) Prior Publication Data

US 2005/0204676 A1 Sep. 22, 2005

(30) Foreign Application Priority Data

Jul. 2, 2002 (AT) ..... A 985/2002

(51) Int. Cl.
*E04B 2/00* (2006.01)

(52) U.S. Cl. ..... 52/592.1; 52/590.1; 52/590.2; 52/592.6; 52/536; 428/60; 428/492

(58) Field of Classification Search ..... 52/592.1, 52/590.1, 590.2, 536, 592.6, 591.1, 589.1; 428/60, 492; 403/339, 340, 381
See application file for complete search history.

(56) References Cited

U.S. PATENT DOCUMENTS 4,426,820 A 1/1984 Terbrack et al.
5,797,237 A * 8/1998 Finkell, Jr. ..... 52/589.1
D406,360 S * 3/1999 Finkell, Jr. ..... D25/138
6,006,486 A 12/1999 Moriau et al.
6,216,409 B1 * 4/2001 Roy et al. ..... 52/589.1

(Continued)

FOREIGN PATENT DOCUMENTS

DE 81 34 756.1 11/1981

(Continued)

*Primary Examiner*—Brian E. Glessner
*Assistant Examiner*—James J Buckle, Jr.
(74) *Attorney, Agent, or Firm*—Kelly K. Reynolds; Steven J. Hultquist; Intellectual Property/Technology Law

(57) ABSTRACT

The invention relates to a panel element comprising a use side, a counter draw opposite the use side, a first side having a tongue, and a second side, which is opposite the first side and which has a slot that is complementary to the tongue. The tongue has a connecting element, which extends essentially perpendicular to the use side and whose cross-section has a first flank and a second flank that is located opposite the first flank. The cross-section of the connecting element has a center line running perpendicular to the use surface. In a first section (45) of the connecting element (4), when viewing in the direction of the use side (11), the slope of the first flank (41) and of the second flank (42) points outward from the center line (44) and the slope of the second flank (42) points toward the center line (44). The distance between the first flank (41) and the second flank (42) decreases perpendicular to the center line (44).

14 Claims, 2 Drawing Sheets

U.S. PATENT DOCUMENTS

| | | | | |
|---|---|---|---|---|
| 6,345,481 | B1 | 2/2002 | Nelson | |
| 6,385,936 | B1 | 5/2002 | Schneider | |
| 6,490,836 | B1 * | 12/2002 | Moriau et al. | 52/589.1 |
| 6,505,452 | B1 | 1/2003 | Hannig et al. | |
| 6,647,690 | B1 | 11/2003 | Martensson | |
| 6,769,219 | B2 | 8/2004 | Schwitte et al. | |
| 6,804,926 | B1 | 10/2004 | Eisermann | |
| 2001/0034992 | A1 * | 11/2001 | Pletzer et al. | 52/581 |
| 2002/0050114 | A1 | 5/2002 | Friso | |
| 2002/0170258 | A1 * | 11/2002 | Schwitte et al. | 52/592.1 |
| 2002/0178681 | A1 | 12/2002 | Zancai et al. | |

FOREIGN PATENT DOCUMENTS

| | | | |
|---|---|---|---|
| DE | 42 42 530 | A1 | 6/1994 |
| DE | 200 08 708 | U1 | 10/2000 |
| DE | 199 29 896 | A1 | 1/2001 |
| DE | 199 33 343 | A1 | 2/2001 |
| DE | 100 08 166 | A1 | 9/2001 |
| DE | 202 03 311 | | 6/2002 |
| DE | 101 20 062 | A1 | 11/2002 |
| EP | 1 026 341 | A2 | 8/2000 |
| WO | WO 00/20706 | | 4/2000 |
| WO | WO 00/47841 | | 8/2000 |
| WO | WO 01/02670 | A1 | 1/2001 |
| WO | WO 02/31291 | A1 | 4/2002 |

* cited by examiner

PANEL ELEMENT AND CONNECTING SYSTEM FOR PANEL ELEMENTS

CROSS-REFERENCE TO RELATED APPLICATIONS

This application is filed under the provisions of 35 U.S.C. §371 and claims the priority of International Patent Application No. PCT/EP2003/006474 filed Jun. 18, 2003, which in turn claims priority of Austrian Patent Application No. A 985/02 filed on Jul. 2, 2002.

FIELD OF THE INVENTION

The present invention relates to a panel element having a utilization side, a counter draw opposite the utilization side, a first side having a tongue, a second side which is located opposite the first side and has a groove with a contour opposite to that of the tongue, the tongue having a connecting element which extends substantially perpendicularly to the utilization side and the cross-section of which has a first flank and a second flank opposite the first flank, the cross-section of the connecting element having a center line extending perpendicularly to the utilization side.

BACKGROUND OF THE INVENTION

In such known panel elements, the tongue and groove joint is established by a movement normal to the utilization side. A shift of the panel elements parallel to the laying plane is not necessary in this case.

DE 100 01 076 C1 discloses a panel element, the tongue of which comprises a hook element having an almost circular cross-section on the face side of the panel element and the groove of which has a recess with opposite contour. The drawback of the tongue and groove joint according to DE 100 01 076 C1 is that a great force is required for connecting the tongue with the groove so that the panel element, in particular the utilization side and/or the edges of the recess, can easily be damaged when laid. When the edges of the recess are damaged, the tongue and groove joint often only gives a minor support so that an undesired disconnection of the tongue and groove joint may occur when the panel element is loaded. Another drawback is that in the case of repeated disconnection and new connection of the tongue and groove joint, the forces transmitted by the tongue and groove joint are strongly reduced on account of the deformations of groove and/or tongue.

FR 2 278 876 A discloses a panel element comprising a tongue having a hook element in the form of a dovetail, a flank of the dovetail being perpendicular to the utilization side. The groove also has a hook element in the form of a dovetail, a flank of the dovetail being perpendicular to the counter draw. A drawback of the panel element of FR 2 278 876 A is that with the tongue and groove joint a contact point is only formed on one side of the hook element so that on account of fabrication tolerances the tongue and groove joint is not clearance-free and there is only a small resistance to a dimensional change of the tongue which is caused by the climate.

WO 01/02670 A1 discloses a panel element comprising a tongue which has the shape of a dovetail, a flank of the dovetail being perpendicular to the decorative side. The groove also has the shape of a dovetail, a flank of the dovetail being perpendicular to the counter draw. A drawback of the panel element according to WO 01/02670 is that with the tongue and groove joint a contact point is only formed on one side of the tongue and/or groove so that on account of fabrication tolerances the tongue and groove joint is not clearance-free. The tongue and groove joint only has a small resistance to a dimensional change of the tongue and/or groove which is caused by the climate since the tongue can be twisted relative to the groove.

SUMMARY OF THE INVENTION

It is therefore the object of the present invention to provide a panel element of the above mentioned kind which avoids the known drawbacks, enables a clearance-free tongue and groove joint, has a great resistance to a dimensional change of the tongue caused by the climate and in which the forces required for establishing the tongue and groove joint are as small as possible.

According to the invention this is achieved because — viewed in the direction of the utilization side (of the top side visible when laid) — the inclinations of the first flank and the second flank point from the center line outwards in a first section of the connecting element and, in a second section, the inclination of the first flank points from the center line outwards and the inclination of the second flank points to the center line, the distance perpendicular to the center line being reduced between the first flank and the second flank.

The advantage of this embodiment is that when the tongue and groove joint is established the locking resistance has its maximum for the first flank and the second flank at different times so as to reduce the necessary force and the danger of a damage of the panel element according to the invention. In addition, on account of the splitting of the locking resistances the inclination of the two flanks of the connecting element can point from the center line outwards in the first section so as to provide a dovetail connection, on the two flanks of which at least one contact point is formed each so that a firm support of the tongue and groove joint is achieved with respect to forces and moments which act substantially normal upon the longitudinal axis of the tongue. By splitting the maximum of the locking resistances, it is also possible to choose a greater inclination on both flanks and keep down the danger of a damage of the panel element resulting from the force required for establishing the tongue and groove joint.

A further development of the invention may provide that the first flank is arranged on the connecting element side facing away from the panel element. A relatively large contact point can be formed on the first flank so as to achieve a particularly good resistance to a dimensional change of the tongue face side caused by the climate in this arrangement.

A further embodiment of the invention may provide that the inclination of the first flank and the inclination of the second flank are substantially constant in the first section. This development corresponds to a conventional dovetail connection in the first section, which can be fabricated easily and has a uniform load distribution at the contact points.

A further development of the invention may provide that the first flank in the first section has an inclination which is less than that of the second flank. The inclination is an important measure of the stresses which can be transmitted between groove and tongue and are normal to the decorative side, greater stresses being transmittable with a greater inclination, without the tongue and groove joint being disconnected. According to this development, stresses normal to the decorative side can be transmitted on the second flank which are greater than on the first flank so that the transmittable forces can be increased on the second flank with a given contact area.

A further embodiment of the invention may provide that the inclination of the first flank is substantially constant in the second section and the same size as the inclination of the first flank in the first section. As a result, an easily producible section is formed on the first flank, the locking resistance of which constantly decreases when the tongue and groove joint is established.

Yet another embodiment of the invention may provide that the second flank is rounded in the second section. The danger of stress peaks on account of a notch effect is reduced by the rounded embodiment.

A further development of the invention may provide that the groove has a recess with a contour opposite to that of the connecting element and when the tongue and groove joint has been established a first contact point is formed on the first flank of the connecting element and a second contact point is formed on the second flank of the connecting element. A clearance-free tongue and groove joint is ensured by the development of the first contact point and the second contact point on the flanks of the connecting element.

A further embodiment of the invention may provide that a first glue channel is made in the recess region facing the counter draw (i.e. the side facing away from the utilization or decorative side) so as to obtain a particularly durable connection between the connecting element and the recess by means of an adhesive.

According to a further embodiment of the invention the groove can have another glue channel, the other glue channel bordering on the face side of the tongue when the tongue and groove joint has been connected. If the tongue and groove joint is adhered by means of an adhesive in the other glue channel, it will have a particularly great resistance to a dimensional change of the tongue face side caused by the climate. Moreover, the penetration of moisture into the connecting element region is prevented.

A further development of the invention may provide that — when the tongue and groove joint has been established — a continuous gap extending between the tongue and the groove up to the second contact point is formed in the region of the groove face side. The formation of the gap serves for ensuring that the tongue and groove joint is seated in the face side region of the tongue and normal forces on the utilization side can directly be transmitted to the groove in the face side region of the tongue so as to reduce the risk of a damage of the tongue.

In a further development of the invention, the sides can at least partially be treated, in particular sprayed, coated or the like, with a hydrophobic agent. This can serve for raising the durability of the panel element according to the invention and the connection according to the invention, the panel element according to the invention remaining dimensionally stable even in the case of penetrating moisture.

Examples of panel elements within the meaning of the invention are parquet panels according to DIN 280 or laminate panels according to EN 13329.

The invention is described in more detail with reference to the attached drawings which show embodiments thereof.

DETAILED DESCRIPTION OF THE INVENTION

Figure 1:
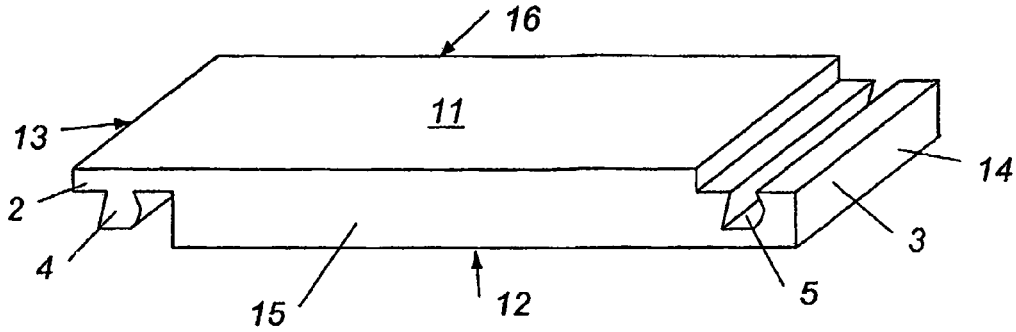
FIG. 1 shows a schematic oblique view of a panel element according to the invention.

FIG. 1 shows a schematic oblique view of a panel element according to the invention. The panel element according to the invention has a utilization side 11, a counter draw 12 opposite the utilization side 11, a first side 13 having a tongue 2 and a second side 14 which is located opposite the first side 13 and has a groove 3 with a contour opposite to that of tongue 2. Tongue 2 comprises a connecting element 4 which extends substantially perpendicularly to the utilization side 11 and the cross-section of which has a first flank 41 and a second flank 42 opposite the first flank 41, the cross-section of the connecting element 4 including a center line 44 extending perpendicularly to the utilization side 11.

The panel element according to FIG. 1 of the invention has a substantially rectangular shape. It may also be square or have another shape, such as rhombic, triangular, hexagonal, octagonal, oval or the like.

According to FIG. 1 the first side 13 and the second side 14 may be face sides (here interfaces transversely to the fiber orientation) of the panel element according to the invention. It may be provided that in each case a tongue 2 and/or a groove 3 is also provided on the longitudinal sides 15, 16. On the longitudinal sides 15, 16, the tongue can be developed in a way differing from that of tongue 2 on the first side 13. Other embodiments of the panel elements according to the invention provide that tongue 2 is formed on one of the longitudinal sides.

Figure 2:
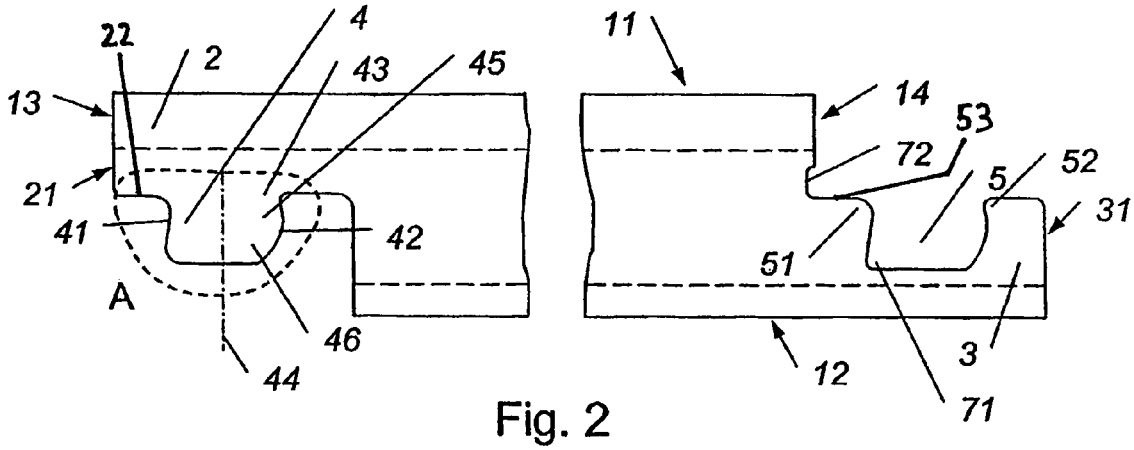
FIG. 2 shows a cross-section of a first embodiment of the panel element according to the invention.

FIG. 2 shows the cross-section of an embodiment of the panel element according to the invention, the cross-section being normal to the longitudinal direction of tongue 2. Viewed in the direction of the utilization side 11, the inclinations of the first flank 41 and the second flank 42 point from the center line 44 outwards in a first section 45 of the connecting element 4. Viewed in the direction of the utilization side, the inclination of the first flank 41 points from the center line 44 outwards in a second section 46 and the inclination of the second flanks points to the center line 44, the distance normal to the center line being reduced between the first flank 41 and the second flank 42.

Figure 4:
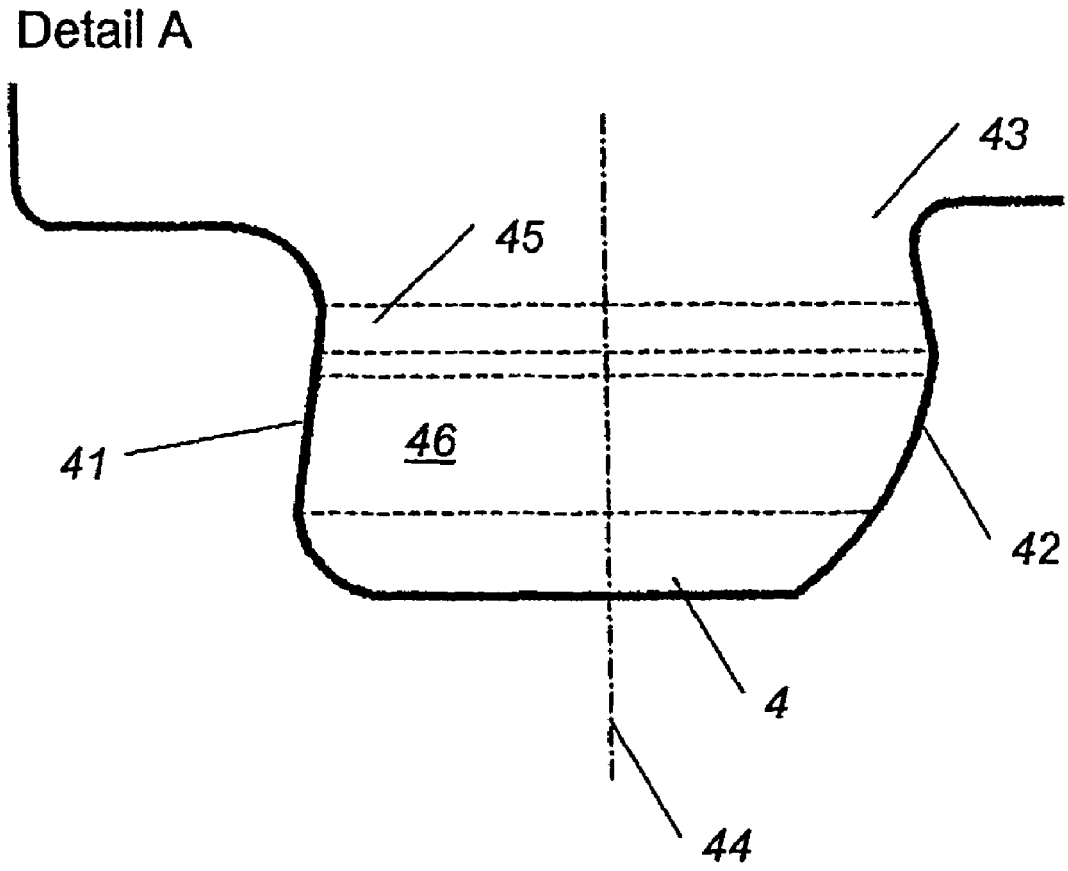
FIG. 4 shows detail A of FIG. 2.

FIG. 4 shows the detail A of the cross-sectional view according to FIG. 2, the first section 45 and the second section 46 being emphasized by dashed lines. In the first section 45, the inclination of the first flank 41 and the inclination of the second flank 42 are substantially constant each. In the first section 45, the connecting element 4 has the shape of a classical dovetail having flanks 41, 42 widening from a root region 43 of the connecting element 4.

In the second section 46, the first flank 41 also has a substantially constant inclination which has the same size as the inclination of the first flank 41 in the first section 45, the development of a substantially constant inclination of the first flank 41 being easily producible in the first section 45 and the second section 46 and a region optionally located between these sections 45, 46.

The second flank 42 can be rounded in the second section 46 so as to ensure an easy introduction of the second flank 42 of tongue 2 into groove 3.

Groove 3 has a recess 5 with a contour opposite to that of the connecting element 4. In groove 3, stress peaks caused by the notch effect are avoided in the rounded embodiment of second flank 42 in the second section 46.

Figure 3:
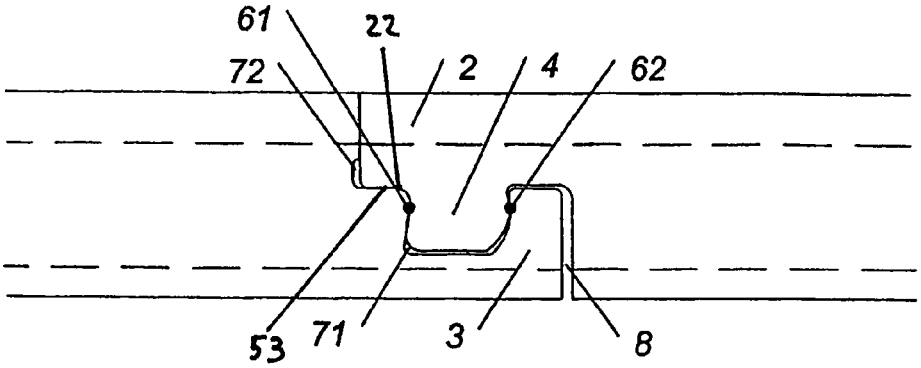
FIG. 3 shows the tongue and groove joint of the panel element according to FIG. 2.

The tongue and groove joint of the embodiment of the panel element according to FIG. 2 of the invention is shown in FIG. 3. When the tongue and groove joint is established, tongue 2 is moved and/or tilted normal to the utilization side towards groove 3, the first flank 41 initially contacting a first edge 51 of recess 5. In a further movement, a deformation occurs on the first flank 41 and the first edge 51, a first locking resistance having to be overcome which has its maximum value when the first flank 41 strikes the first edge 51. At this position, the second flank 42 does not contact the second recess edge 52 opposite the first edge 51 so that no locking resistance occurs on the second flank 42 at this position. Having overcome the maximum of the first locking resistance on the first flank 41, the second flank 42 approaches the second edge 52 on further moving until it contacts the latter and a second locking resistance occurs on the second flank 42, the maximum of the second locking resistance not occurring simultaneously with the maximum of the first locking resistances so that the force required for establishing the tongue and groove joint is less than the sum of the maximum of the first locking resistance and the maximum of the second locking resistance.

The force required for establishing the tongue and groove joint directed transversely to the laying plane can be applied by means of a hammer blow onto a tapping block. The arrangement of the panels according to the invention with respect to one another is clearance-free, joint-free and can be disconnected without being destroyed.

On the top side of edge 51, a first reference surface 53 extending parallel to the utilization surface 11 is formed on the groove-side face side 14, which has a vertical distance from the utilization surface 11 the same as that of the opposite second reference surface 22 formed on the tongue-side face side 13 and parallel to the utilization surface 11, which when laid is arranged on the bottom side of tongue 2 between face side 21 and flank 41. When connected, tongue 2 rests on edge 53. On account of this equal vertical distance of the first 53 and second 22 reference surfaces from utilization surface 11 a positive engagement occurs between the first 53 and second 22 reference surfaces when the tongue and groove joint has been established, as follows from FIG. 3. As a result, it is easier to obtain a gap-free surface (without a difference in level) in the laid state.

When the tongue and groove joint has been established, a first contact point 61 is formed on the first flank 41 and a second contact point 62 is formed on the second flank 42 which are outlined in FIG. 3 by a dot each.

The force transmittable by one of the contact points 61, 62 and normal to the utilization surface 11 is proportional to the area of contact point 61, 62 and the inclination of flank 41, 42 of the connecting element 4 on the side of contact point 61, 62. Since the area of the contact point 61 can be larger than that of contact point 62, it appears advantageous for the first flank 41 in the first section 45 to have an inclination less than that of the second flank 42, so that the amount of the forces transmittable normal to the utilization surface 11 of contact points 61, 62 can be mutually approximated.

It has also proved advantageous — when the tongue and groove joint has been established — for a gap 8 to extend between tongue 2 and groove 3 up to the second contact point 62 forms in the region of the face side 31 of groove 3. This serves for ensuring that in the region of the utilization side 11 the face side 21 of the tongue abuts in a gap-free manner against the utilization side 11 of the adjoining panel element according to the invention, wherein tolerances resulting from manufacture can be compensated by gap 8. It can also be ensured that the tongue and groove joint is seated in the region of face side 21 of tongue 2 and normal forces on the utilization side 11 can be transmitted directly onto groove 3 and a floor underneath in the face-side region of tongue 2 so that no bending moments occur in the tongue and the danger of damage to tongue 2 is small.

If the panel element according to the invention, which is shown on the right of FIG. 3, is turned clockwise and downwards, it is substantially contact point 61 that counteracts this movement. In this connection, it appears to be advantageous for the first flank 41 to be arranged on the side facing away from the panel element of connecting element 4 since the first contact point 61 can be larger than the second contact point 62 and therefore reduced stresses occur with a given load. The contact point also counteracts a dimensional change in the tongue caused by the climate.

A particular durable and loadable tongue and groove joint can be achieved where tongue 2 is adhered to groove 3. For this purpose, a first glue channel 71 may be formed in the region of recess 5 facing the counter draw 12. In the embodiment shown in FIG. 3, the glue channel 71 extends over the entire width of the cross-section of recess 5. In other embodiments, a region of recess 5 can also be recessed and form the glue channel 71.

In addition, groove 3 may have another glue channel 72, the other glue channel 72 bordering on the face side 21 of tongue 2 when the tongue and groove joint has been established. An adhesion of tongue 2 with groove 3 in the region of the other glue channel 72 effects a particularly high resistance to a dimensional change of the face side 21 of tongue 2, which is caused by the climate. Moreover, the penetration of moisture into the region of the connecting element 4 is prevented.

A long durability of the panel element according to the invention and the connection according to the invention can be achieved when sides 13, 14, 15, 16 are at least partially treated, in particular sprayed, coated or the like, with a hydrophobic agent.

The invention claimed is:

1. A panel element comprising: a utilization side, a counter draw opposite the utilization side, a first side having a tongue, a second side which is located opposite the first side and has a groove with a contour opposite to that of the tongue, the tongue having a connecting element which extends substantially normal to the utilization side and whose cross-section has a first flank and a second flank opposite the first flank, the cross-section of the connecting element having a first section and a second section essentially parallel to the plane of the utilization side, wherein the first section comprising a root region of the connecting element positioned near the utilization side and the second section positioned adjacent and outermost to the first section and the cross-section of the connecting element having a center line normal to the utilization side and—viewed in the direction from the utilization side to the counter draw—the inclination of the first flank and the second flank each points from the center line outwards in the first section of the connecting element, the cross-section of the connecting element is widened from the root region of the connecting element throughout the first section, and in the second section the inclination of the first flank points from the center line outwards and the inclination of the second flank points to the center line, the distance normal to the center line being reduced between the first flank and second flank, wherein the first flank is arranged on the side of the connecting element proximal to the first side of the panel element and the second flank is arranged on the side of the connecting element distal to the first side of the panel element.

2. The panel element according to claim 1, wherein the inclination of the first flank and the inclination of the second flank are substantially constant in the first section.

3. The panel element according to claim 2, wherein the first flank has an angle inclination smaller in the first section than that of the second flank in the first section.

4. The panel element according to claim 2, wherein the inclination of the first flank is substantially constant in the second section and commensurates with the inclination of the first flank in the first section.

5. The panel element according to claim 1, wherein the second flank of the connecting element is rounded in the second section.

6. The panel element according to claim 1, wherein the groove has a recess with a contour opposite to that of the connecting element and, when the groove is connected with the tongue of another similar panel element, the connecting element with the first and second flank of the another similar panel element is inserted into the recess of the groove, wherein a first contact point is formed between the first flank of the connecting element of the another similar panel element and the groove and a second contact point is formed between the second flank of the connecting element of the another similar panel element and the groove essentially opposite to the first contact point.

7. The panel element according to claim 6, characterized in that a glue channel is formed in the recess of the groove on a surface of the recess parallel to the counter draw side.

8. The panel element according to claim 1, wherein the groove further comprises a glue channel, and wherein the glue channel is an undercut adjacent and parallel to the utilization side and is positioned opposite to the face side of tongue of the other similar panel element when groove is connected with tongue of the other similar panel element.

9. The panel element according to claim 8, wherein when the tongue of one panel is connected with the groove of another similar panel element — a continuous gap is formed adjacent to at least a section of the second side.

10. The panel element according to claim 9, wherein vertical sides and sides perpendicular thereto of the panel element are at least partially treated with a hydrophobic agent.

11. An interlocking floor system comprising at least two panel elements, wherein a panel element comprises:

a utilization side;

a counter draw side opposite to the utilization side;

a first side essentially normal to the utilization side, wherein the first side comprises a tongue positioned near the utilization side and extending beyond the counter draw side;

a second side which is located opposite the first side, wherein the second side comprises a groove positioned near the counter draw side, and wherein the groove extends beyond the utilization side and includes a contour opposite to that of the tongue;

wherein the tongue comprises a connecting element which extends vertically away from the utilization side and substantially normal to the utilization side; wherein the connecting element has a cross-section comprising:

a first flank arranged on the side of the connecting element proximal to the first side of the panel element and a second flank arranged on the side of the connecting element distal to the first side of the panel element;

a first section and a second section that are essentially parallel to the plane of the utilization side and extend between the first and second flanks, wherein the first section comprising a root region of the connecting element is positioned near the utilization side and the second section is positioned adjacent and outermost to the first section; and the cross-section of the connecting element having a center line normal to the utilization side, and wherein the cross-section of the connecting element is widened from the root region of the connecting element throughout the first section, and wherein in the first section the distance from the center line to the first flank is less than the distance from the center line to the second flank, and wherein in the second section, the distance from the center line to the first flank gradually increases at a constant angle while the distance from the center line to the second flank gradually decreases on an arcuating incline.

12. The interlocking floor system according to claim 11, wherein in the first section the distance from the center line to the first flank is increasing and the distance from the center line to the second flank is increasing.

13. The panel element according to claim 11, wherein the distance from the center line to the first flank and the distance from the center line to the second flank are measured along a single plane perpendicular to the center line.

14. The panel element according to claim 6 wherein the second flank of the connecting element is rounded in the second section and the second contact point between the connecting element of the another similar panel element and the groove is formed on the rounded section of the second flank essentially opposite to the first contact point.

* * * * *